US006451234B1

(12) United States Patent
Cliver et al.

(10) Patent No.: US 6,451,234 B1
(45) Date of Patent: Sep. 17, 2002

(54) PROCESS FOR PRODUCING DYED TEXTILE MATERIALS HAVING HIGH LEVELS OF COLORFASTNESS

(75) Inventors: James D. Cliver, Spartanburg; Dale R. Williams, Greer, both of SC (US)

(73) Assignee: Milliken & Company, Spartanburg, SC (US)

( * ) Notice: Subject to any disclaimer, the term of this patent is extended or adjusted under 35 U.S.C. 154(b) by 0 days.

(21) Appl. No.: 09/514,073

(22) Filed: Feb. 26, 2000

(51) Int. Cl.[7] ..... B01D 3/02; B29C 71/02; D06M 13/356; D06P 5/02

(52) U.S. Cl. ..... 264/78; 8/115.6; 8/497; 264/129; 264/234; 264/345; 427/316; 427/387; 427/393.5

(58) Field of Search ..... 264/78, 129, 234, 264/345; 8/115.56, 115.6, 497; 427/316, 387, 393.5

(56) References Cited

U.S. PATENT DOCUMENTS

| | | | | |
|---|---|---|---|---|
| 3,639,154 A | * | 2/1972 | Sawa et al. | 427/387 X |
| 3,668,001 A | * | 6/1972 | Hosokawa et al. | 442/184 |
| 4,743,269 A | * | 5/1988 | Haebler et al. | 8/639 |
| 4,745,142 A | | 5/1988 | Owaki et al. | |
| 5,384,082 A | | 1/1995 | Frankfort et al. | |
| 5,645,936 A | | 7/1997 | Frankfort et al. | |
| 5,725,604 A | * | 3/1998 | Fritzsche et al. | 8/543 |
| 5,855,623 A | | 1/1999 | English et al. | |
| 5,928,720 A | | 7/1999 | Kuhn et al. | |

FOREIGN PATENT DOCUMENTS

| | | | |
|---|---|---|---|
| DE | 1966382 A | * | 10/1972 |
| DE | 19633616 A1 | * | 2/1998 |
| GB | 1057626 A | * | 2/1967 |
| WO | WO-9403514 A1 | * | 2/1994 |

OTHER PUBLICATIONS

International Search Report for PCT/US01/05410 (Aug. 30, 2001).*

* cited by examiner

*Primary Examiner*—Leo B. Tentoni
(74) *Attorney, Agent, or Firm*—Terry T. Moyer; Sara M. Current

(57) ABSTRACT

Textile materials having high colorfastness, and methods for their production are described. The process involves heat-setting a textile material, then applying a polysiloxane/catalyst combination to the heatset material. The textile material is then dried at low temperature, thereby resulting in a material having good colorfastness and shade. The process can be used to process fibers, yarns or fabrics, and is particularly useful in the processing of microdenier fibers.

11 Claims, No Drawings

PROCESS FOR PRODUCING DYED TEXTILE MATERIALS HAVING HIGH LEVELS OF COLORFASTNESS

FIELD OF THE INVENTION

The invention generally relates to a process for improving the colorfastness of dyed thermoplastic textile materials, and textile materials having improved colorfastness. More specifically, the invention relates to a process for dyeing textile materials such as microdenier fibers and fabrics made from microdenier fibers, which provides the materials with superior colorfastness capabilities along with desirable strength and aesthetic characteristics.

BACKGROUND OF THE INVENTION

Textile fibers are commonly used in a variety of end uses. In many cases, it is desired that the fibers provide certain visual and aesthetic characteristics, as well as particular functional characteristics. For example, fibers are commonly dyed to achieve particular colors, in order to provide a certain visual appearance to the products which they are used to make.

One problem associated with the dyeing of fibers is that it can be difficult in some cases to achieve good colorfastness while maintaining desired functional characteristics. To this end, the type of dye and processing method used to dye products must be selected to provide the desired end performance characteristics, and optimal levels of particular parameters may have to be sacrificed to achieve acceptable levels of other characteristics.

Recent developments in the synthetic fiber industry have enabled the production of finer denier fibers than heretofore achievable. Such filaments typically have a silkier feel than those of larger size, and therefore can be used to achieve fabrics having improved hand characteristics as compared with those formed from larger filaments. In particular, it has been found that other things being equal, a fabric made from a yarn bundle formed of a plurality of fine denier fibers will generally have a better hand than a fabric made from similarly-sized yarns made from larger denier fibers. Therefore, the demand for microdenier fibers and fabrics made from microdenier fibers continues to increase as their desirability is recognized by consumers and manufacturers.

One disadvantage associated with fine denier fibers (such as microdenier fibers, which are typically considered to be those which have a denier per filament ratio of 1.0 or smaller) is that it is typically more difficult to achieve an equivalent depth of shade when dyeing as compared with their larger counterparts. Such finer denier fibers generally have inferior colorfastness as compared with larger-sized fibers, particularly with darker, deeper shades of dye. As the size of a fiber (i.e. the denier per filament or "dpf") decreases, the proportion of fiber surface area to total fiber composition increases. As a result, a greater percentage of colorant or dyestuff by weight is generally required to achieve an equivalent depth of shade as compared to that required for conventional larger sized fibers.

Dyeability can be particularly difficult to achieve for darker-colored fibers, as such colors typically require the application and retention of an even greater percentage of dye substance. For example, it is not uncommon for microdenier fibers to require the application or incorporation of as much as three times the amount of dyestuff or colorant as that required for larger fibers, in order to achieve a similar dark shade. Correspondingly, the microdenier fibers typically have lower colorfastness than their larger denier counterparts, which can present problems in their end use. For example, the dyes can be released during subsequent washing of the fibers or articles which they are used to make. Not only does this diminish the integrity of the color of the article, but the freed dye molecules can undesirably attach to other articles in the same wash bath, adversely affecting their color. For this reason, it can be difficult for manufacturers to provide single items incorporating distinct regions of highly contrasting colors, particularly when the regions include microdenier fibers, since the dyes of the darker region tend to bleed onto the lighter colored regions during laundering.

Current practices for addressing the problems associated with the poor colorfastness of microdenier fibers include utilizing expensive high fastness dyes, applying strong reductive chemicals to the fabric or yarn after dyeing, and/or heat treating the fabric to normal heatsetting temperatures (e.g. about 340° to 380° Fahrenheit for polyester) prior to dyeing. Each of these processes will be described more specifically below; all have proven to be insufficient in achieving good coloration and colorfastness on the most difficult shades.

As noted, high colorfastness dyes, which typically utilize benzodifuranone or thiophene structures, etc., can be used to improve colorfastness. However, they are typically much more expensive than conventional dyes. Therefore, it can be difficult to achieve dyed yarns and fabrics using these high colorfastness dyes at desirable levels of cost. Furthermore, the colorfastness achieved by such dyes is still below what would be optimal under normal processing conditions.

Another method for enhancing colorfastness of microdenier materials involves applying a strong reductive chemical to the fabric or yarn after processing. The reductive process or reductive "clear" as it is known, functions to clear and destroy the dye molecules which have not attached securely to the textile material, so that they are not later released. However, the chemicals used in the clearing process can fail to remove all of the weakly attached dye molecules, and therefore they often do not eliminate the problem. In addition, the reductive chemicals can have a deleterious effect on the strength of the fabric. Furthermore, subsequent processes such as drying or heatsetting can liberate additional dye molecules from the fiber structure.

A further method for attempting to enhance the colorfastness of microdenier materials involves pre-heat treating the material at normal heatset temperatures in order to stabilize it for dyeing. For example, polyester is typically heatset at a temperature from about 340° F. to about 380° F. (i.e. about 171° C. to 193° C.) and therefore a pre-heat treatment would generally be performed at these same temperatures. Generally, it is considered to be desirable to minimize the formation of highly crystalline regions, as such are considered to be undyeable. Therefore, it is usually considered to be desirable to minimize the temperature at which the fabric is heatset to the extent possible. This is especially true of microdenier fibers and microdenier fiber-containing fabrics because of the aforementioned problem of greater surface area increasing the dye requirement. An improvement of this method is disclosed in commonly-assigned co-pending U.S. patent application Ser. No. 09/472,694 for "Process for Making Dyed Textile Materials Having High Colorfastness, and Materials Made Therefrom."

A further method for attempting to enhance the colorfastness of microdenier materials involves pre-heat treating the material at normal heatset temperatures in order to stabilize it for dyeing. For example, polyester is typically heatset at a temperature from about 340° F. to about 380° F. (i.e. about 171° C. to 193° C.) and therefore a pre-heat treatment would generally be performed at these same temperatures. Generally, it is considered to be desirable to minimize the formation of highly crystalline regions, as such are considered to be undyeable. Therefore, it is usually considered to be desirable to minimize the temperature at which the fabric is heatset to the extent possible. This is especially true of microdenier fibers and microdenier fiber-containing fabrics because of the aforementioned problem of greater surface area increasing the dye requirement. An improvement of this method is disclosed in commonly-assigned co-pending U.S. patent application Ser. No. 091472,694 for "Process for Making Dyed Textile Materials Having High Colorfastness, and Materials Made Therefrom", filed Dec. 27, 1999.

It has also been proposed to enhance fiber colorfastness through the application of chemistry designed to assist in dye retention. For example, one manufacturer has proposed the application of a polysiloxane and organo-tin combination according to specific application processes. The proponents of the polysiloxane/organo-tin combination maintain that the polysiloxane/organo-tin compound is activated by temperatures of 340°–380° (i.e., normal heatset temperatures for polyester). They therefore teach that the compound must be applied to the fabric and subsequently heatset. One problem associated with this method is that it typically results in a shade change from the original dyed color of the textile material, with the shade change often being severe.

While each of these practices and combinations thereof are considered to assist in improving the colorfastness of the microdenier materials, the colorfastness of such materials is still generally considered to be inferior to that of standard denier filaments. To further improve the colorfastness of microdenier materials, the finished fabrics are in some cases reloaded into a dye machine and treated with a reductive scour. In fact, in some cases it has been found that acceptable results can be achieved by this method. However, this process adds the steps of unrolling and batching a set for the dye machine, reloading and scouring, unloading, detwisting and drying, and therefore can be expensive to perform. Furthermore, this process reduces production dyeing capacity, adds length to the processing time and is not always successful. In addition, this method creates the risk of causing other off-quality characteristics and in some cases may change the material parameters through the use of so many additional processing steps.

Because of the difficulties associated with obtaining microdenier materials with good colorfastness as noted above, many manufacturers simply limit the depth of shades offered in connection with microdenier fabrics. As will be readily appreciated by those of ordinary skill in the art, this can be unacceptable from an end user's standpoint, since this limits the designers' creative freedom in designing new product offerings.

DETAILED DESCRIPTION

In the following detailed description of the invention, specific preferred embodiments of the invention are described to enable a full and complete understanding of the invention. It will be recognized that it is not intended to limit the invention to the particular preferred embodiment described, and although specific terms are employed in describing the invention, such terms are used in a descriptive sense for the purpose of illustration and not for the purpose of limitation.

The instant invention overcomes many of the disadvantages associated with the prior art constructions by achieving fibers having superior colorfastness properties, while retaining strength and other functional capabilities. In addition, the fabrics made by this method have been found to have a better hand than comparable fabrics made by prior art methods. Furthermore, the instant invention enables the achievement of products having superior colorfastness at reasonably comparable levels of cost to products having significantly inferior levels of colorfastness.

For purposes of illustration, the process will be described in connection with the dyeing of fabrics, and in particular, with the dyeing of polyester fabrics. It is noted, however, that the process is equally applicable to the processing of fibers or yarns, as well as other types of textile materials, within the scope of the instant invention.

The process involves providing or obtaining a textile material, which may be a textile fiber, a spun or filament yarn, or a fabric. Where the process is used in connection with the processing of fabrics, it may be in the form of a woven fabric, knit fabric, nonwoven fabric, or the like.

The fibers or yarns can have any size or denier desired. However, it has been found that the process of the instant invention performs particularly well in connection with the manufacture of microdenier fibers (i.e., those having a denier below one dpf) and yams and fabrics incorporating those fibers.

In addition, the textile material is desirably a thermoplastic material. For example, the process can be applied to thermoplastic components such as polyester, poly (trimethylene terephthalate) ("PTT"), polyamides, nylons, etc.

Depending on the manufacturing techniques used to produce the textile material and the type of end product desired, the textile material can optionally be de-sized and/or scoured to prepare it for processing. In addition, the textile material can be subjected to other forms of processing such as sanding, sueding, or the like at any stage in the process, but preferably prior to the application of the polysiloxane/organo-tin chemistry combination (which will be discussed further herein.) The textile material may also be heatset prior to dyeing if desired, depending on the end properties desired to be achieved.

The textile material is then desirably dyed to achieve a selected color. For example, the textile may be jet dyed, jig dyed, beck dyed, beam dyed or dyed in any conventional manner using time and temperature profiles designed to achieve a particular shade.

The textile material may then optionally be aftercleared by applying a reducing agent designed to remove excess dye molecules. The fabric may also be rinsed if desired, to ensure the removal of the reducing agent and loose but undestroyed dye molecules. For example, the material could be processed through a bath of sodium hydrosulfite to destroy the poorly attached dye molecules. In a preferred form of the invention, afterclearing is performed by applying 2.0% o.w.g. Soda Ash and 0.5% o.w.g. Thiourea Dioxide at 160° F. In some cases, it has been found that superior colorfastness can be achieved even without the afterclear step, when the textile material is subsequently processed in accordance with the instant invention.

The textile material is also heatset in a conventional manner. As will be readily appreciated by those having ordinary skill in the art, "heatsetting" refers to the process of conferring dimensional stability to manufactured fibers, yarns and fabrics through the application of wet or dry heat. In other words, the temperature of the thermoplastic material is raised sufficiently above its glass transition temperature (which is specific to each type of thermoplastic material) so as to soften the polymer enough to rearrange or realign the polymer structure to the desired shape (e.g., as by the tension on the textile). For example, polyester is generally heatset at temperatures of about 340° F. to about 380° F. The heatsetting can be done before or after dyeing, although it will generally be preferred when processing knit fabrics to heatset after dyeing, in order to avoid de-knitting during the dye process or excessive curling of the fabric edges which can lead to uneven dyeing.

The textile material is then treated with a polysiloxane/catalyst combination. Preferably, this combination includes 1–10 g/L of polysiloxane along with a suitable catalyst. In a preferred form of the invention, the combination includes about 6 g/L polysiloxane and about 3 g/L of an organo-tin component. For example, this concentration has been found to work well in the processing of polyester materials, where a wet pick up of about 60% to about 65% is to be expected. However, as will be readily appreciated by those of ordinary skill in the art, the concentration can be adjusted with routine experimentation to achieve the optimal performance, depending on the type of material to be processed and its associated wet pick-up percentage, etc.

The textile material is then dried, preferably at relatively low temperatures. In a preferred form of the invention, the textile material is dried at a temperature which is at least about 15%, more preferably at least about 20%, and more preferably at least about 25% less than the temperature at which it is heatset. For example, in the case of a polyester material, the heatsetting is desirably performed at about 340° F. to about 380° F. and above, and the drying is performed at about 250° F. to about 325° F. Even more preferably, heatsetting is performed at about 370° F. and drying is performed at about 220° F. In most cases, it is generally preferred that the textile material is dried at a temperature of about 300° F. or less, and more preferably about 275° F. or less.

The thus-produced textile materials have superior colorfastness as compared with prior art dyed materials, particularly in connection with fine denier textile materials, including microdenier fibers. In fact, it has been found that a 4.0 or greater can be achieved on each fiber when tested according to AATCC Colorfastness Test Method 61 for most dye colors. As illustrated below, the process of the invention has been shown to increase the average washfastness rating of polyester microdenier fabrics an average of 0.5 point on polyester, 0.8 point on nylon, and 0.4 point on cotton, as compared with the ratings achieved by conventional methods. In addition, the high levels of colorfastness can be achieved even at relatively high levels of dye add-on. For example, it has been found that the 4.0 wash test results can be achieved on microdenier fabrics even when the dye add-on percentages are 3.5% o.w.g. or greater, 4.5% o.w.g. or greater, 6% o.w.g or greater, and even at 8% o.w.g. or greater.

EXAMPLES

Example I

A fabric was woven in a right hand twill construction using 1/140/200 polyester yarns in the warp and 1/1 50/100 polyester yarns in the filling. The fabric was prepared in a conventional manner and dyed using a dyestuff mixture containing 3.9100% Disperse Yellow Dye Mixture, 1.2700% C.I. Disperse Violet 91, and 4.0000% C.I. Disperse Blue 284, to obtain a dark green color.

Sample A1 was maintained as a control, meaning that it was processed in a conventional manner by dyeing, afterclearing with 2.0% o.w.g. Soda Ash and 0.5% o.w.g. Thiourea Dioxide at 160° F. for 20 minutes. The fabric was then heatset at 375° F.

Sample A2 was pre-heatset at 375° F. prior to dyeing, dyed, then dried at 300° F.

Sample A3 was pre-heatset at 375° F. and a mixture of polysiloxane and an organo-tin compound (6 g/L polysiloxane and 3 g/L of the organo-tin component) was padded onto the fabric. The fabric was then dried at 300° F.

Samples A4 and A5 were processed in the same manner as Sample A3, with the exception that they were dried at 350° F. and 380° F., respectively.

The results are listed in Table I below:

TABLE I

| | IIA Wash Test | | |
|---|---|---|---|
| Sample | Polyester | Nylon | Cotton |
| A1 (control) | 3.0 | 2.0 | 4.0 |
| A2 | 4.0 | 3.0 | 4.5 |
| A3 | 4.5 | 4.0 | 4.5 |
| A4 | 3.5 | 2.5 | 4.0 |
| A5 | 3.5 | 2.0 | 3.5 |

As illustrated above, the most desirable results were achieved by the process of the instant invention, as shown at A3. As also was apparent, as the drying temperature increased above 300° F. (e.g., at A4 and A5), the colorfastness decreased.

Example II

A fabric was jersey knit from 1/70/100 polyester yams. The fabric was dyed a royal blue color using the following dye combination: 0.0003% C.I. Disperse Yellow 108, 0.0500% C.I. Disperse Red 279, and 4.2600% Disperse Blue 56.

Sample B1 was maintained as a control, meaning that it was processed in a conventional manner by dyeing and afterclearing with 2.0% o.w.g. Soda Ash and 0.5% o.w.g. Thiourea Dioxide at 160° F. for 20 minutes. The fabric was then heatset at 370° F.

B2 was tested prior to heatsetting (i.e. after jet dyeing and afterclearing with 2.0% o.w.g. Soda Ash and 0.5% o.w.g. Thiourea Dioxide at 160° F. for 20 minutes).

Sample B3 was heatset at 380° F. after dyeing and afterclearing in the manner of B1.

Samples B4, B5, and B6 were dyed and aftercleared with 2.0% o.w.g. Soda Ash and 0.5% o.w.g. Thiourea Dioxide at 160° F. for 20 minutes. The samples were then padded with a mixture of polysiloxane and an organo-tin compound (included 6 g/L polysiloxane and 3 g/L of the organo-tin component.) The fabrics were then heatset at 380° F., 360° F. and 340° F., respectively. In other words, Samples B4, B5 and B6 were processed according to the parameters described previously as being recommended for the method of using a polysiloxane/organo-tin compound to enhance colorfastness.

The fabrics were tested for washfastness according to AATCC Test Method 61, and shade was measured using a Hunter Lab spectrophotometer. The results are listed below in Table II.

TABLE II

| | IIA Wash Test | | | Shade | | |
|---|---|---|---|---|---|---|
| Sample | Polyester | Nylon | Cotton | DL | Da | Db |
| B1 (control) | 4.0 | 3.0 | 4.5 | 0 | 0 | 0 |
| B2 | 4.5 | 4.0 | 5.0 | Na | Na | Na |
| B3 | 4.0 | 3.0 | 4.5 | −117 | 120 | −3 |
| B4 | 4.5 | 3.5 | 4.5 | −156 | 21 | 272 |
| B5 | 4.5 | 3.5 | 4.5 | −160 | −50 | 323 |
| B6 | 4.5 | 3.5 | 4.5 | −198 | 39 | 187 |

Although achieving good results for polyester and cotton, the nylon had lower performance results than what would be optimal.

Example III

A jersey knit fabric was prepared using 2/70/100 and 1/701100 polyester yarns. The fabric was jet dyed using a dye mixture of 3.8800% C.I. Disperse Orange 30, 0.8800% C.I. Disperse Red 167, and 4.6400% Disperse Navy dye mixture to achieve a black fabric.

C1 was maintained as the control, meaning that it was processed in a conventional manner by dyeing, afterclearing with a 2.0% o.w.g. Soda Ash and 0.5% o.w.g. Thiourea Dioxide at 160° F. for 20 minutes. The fabric was then heatset at 370° F.

C2 was jet dyed only.

C3 was heatset at 380° F. after dyeing and afterclearing in the manner of C1.

Samples C4 and C5 were treated with a mixture of polysiloxane and an organo-tin compound (6 g/L polysiloxane and 3 g/L of the organo-tin component) following dyeing and afterclearing in the manner of C1, and heatset at 360° F. and 340° F., respectively. In other words, the process followed here was that described above as being the conventional method for using a polysiloxane/organo-tin compound.

The fabrics were tested for washfastness according to MTCC Test Method 61 and shade was measured using a Hunter Lab spectrophotometer. The results are listed below in Table III.

TABLE III

| | IIA Wash Test | | | Shade | | |
|---|---|---|---|---|---|---|
| Sample | Polyester | Nylon | Cotton | DL | Da | Db |
| C1 | 3.0 | 2.5 | 4.0 | 0 | 0 | 0 |
| C2 | 4.5 | 4.0 | 5.0 | Na | Na | Na |
| C3 | 3.5 | 3.0 | 4.0 | −81 | 61 | 17 |
| C4 | 4.5 | 3.5 | 4.5 | −13 | 38 | 49 |
| C5 | 4.5 | 3.5 | 4.5 | −88 | 15 | 46 |

As illustrated, the samples having a polysiloxane/organo-tin compound applied in the conventional manner had only a 3.5 colorfastness rating on nylon.

Table IV below illustrates the current commercial colorfastness expectations for an acceptable lot of textile material (microfiber) for each of the colors shown below in D-H in Example IV.

TABLE IV

| | IIA Wash Test | | |
|---|---|---|---|
| Color | Polyester | Nylon | Cotton |
| Sample D Dark Navy | 4.0 | 3.5 | 4.5 |
| Sample E Medium Navy | 3.5 | 3.5 | 4.5 |
| Sample F Bright Red | 3.5 | 3.0 | 4.5 |
| Sample G Deep Red | 3.5 | 2.5 | 4.5 |
| Sample H Black | 4.0 | 3.5 | 4.5 |

Example IV

A 100% polyester jersey microdenier fabric was knit from 1/70/100 yarns. Samples of the fabric were dyed various colors and treated as follows:

Sample D- Dark Navy

Dye Mixture: 1.4676% o.w.g. Disperse Yellow dye mixture, 1.4744% o.w.g. C.I. Disperse Violet 91, and 2.7550% C.I. Disperse Blue 284.

D1- Was dyed and aftercleared in a conventional manner using an afterclear of 2.0% o.w.g. Soda Ash and 0.5% o.w.g. Thiourea Dioxide at 160° F. for 20 minutes. The fabric was then heatset at 370° F.

D2- Was dyed and aftercleared as in D1, then heatset at 370° F., then padded with a mixture of a polysiloxane and an organo-tin compound (6 g/L polysiloxane and 3 g/L of the organo-tin component). The fabric was then dried at 275° F.

Sample E- Medium Navy

Dye Mixture: 0.5000% o.w.g. C.I. Disperse Yellow 108, 0.7900% o.w.g. Disperse Red dye mixture, and 3.0000% C.I. Disperse Blue 281.

E1- Was dyed and aftercleared in a conventional manner using an afterclear of 2.0% o.w.g. Soda Ash and 0.5% o.w.g. Thiourea Dioxide at 160° F. for 20 minutes. The fabric was then heatset at 370° F.

E2- Was dyed and aftercleared as E1, then heatset at 370° F., then padded with a mixture of a polysiloxane and an organo-tin compound as in D2. The fabric was then dried at 275° F.

Sample F- Bright Red

Dye Mixture: 0.4100% o.w.g. C.I. Disperse Orange 30, 4.5000% o.w.g. C.I. Disperse Red 356, 2.3500% o.w.g. C.I. Disperse Red 279, and 0.0150% o.w.g. C.I. Disperse Blue 56.

F1- Was dyed and heatset at 370° F. without an afterclear process.

F2- Was dyed heatset at 370° F. without an afterclear process and treated with a mixture of a polysiloxane and an organo-tin compound in the same concentration as in D2. The fabric was then dried at 275° F.

F3- Was dyed and aftercleared in a conventional manner using an afterclear of 2.0% o.w.g. Soda Ash and 0.5% o.w.g. Thiourea Dioxide at 160° F. for 20 minutes. The fabric was then heatset at 370° F.

F4- Was dyed and aftercleared as F3, then heatset at 370° F., then padded with a mixture of a polysiloxane and an organo-tin compound in the concentration described in D2. The fabric was then dried at 275° F.

Sample G- Deep red

Dye Mixture: 1.0500% o.w.g. Disperse Yellow dye mixture, 3.0000% o.w.g. C.I. Disperse Red 167, and 1.0000% o.w.g. C.I. Disperse Violet 91.

G1- Was dyed and aftercleared in a conventional manner using an afterclear of 2.0% o.w.g. Soda Ash, and 0.5% o.w.g. Thiourea Dioxide at 160° F. for 20 minutes. The fabric was then heatset at 370° F.

G2- Was dyed and aftercleared as G1, then heatset at 370° F., then padded with a mixture of a polysiloxane and an organo-tin compound in the concentration described in D2. The fabric was then dried at 275° F.

Sample H- Black

Dye Mixture: 3.1500% o.w.g. C.I. Disperse Orange 30, 0.8200% o.w.g. C.I. Disperse Red 167, and 4.0000% o.w.g. C.I. Disperse Blue 281.

H1- Was dyed and aftercleared in a conventional manner using an afterclear of 2.0% o.w.g. Soda Ash, and 0.5% o.w.g. Thiourea Dioxide at 160° F. for 20 minutes. The fabric was then heatset at 370° F.

H2- Was dyed and aftercleared as H1, then heatset at 370° F., then padded with a mixture of a polysiloxane and an organo-tin compound in the concentration described in D2. The fabric was then dried at 275° F.

Al of the samples were then tested for washfastness, crocking, and shade.

Wash test data and Shade Test results for samples D–H are listed below in Table V.

TABLE V

| | IIA Wash Test | | | Shade | | | |
|---|---|---|---|---|---|---|---|
| Sample | Polyester | Nylon | Cotton | DL | Da | Db | DE |
| D1 | 5.0 | 4.0 | 4.5 | Std | — | — | — |
| D2 | 5.0 | 4.5 | 4.5 | −34 | 14 | 7 | 37 |
| E1 | 4.5 | 3.5 | 4.5 | Std | — | — | — |
| E2 | 4.5 | 4.0 | 4.5 | 1 | −12 | 30 | 32 |
| F1 | 3.5 | 3.0 | 4.5 | Std | — | — | — |
| F2 | 4.0 | 4.0 | 4.5 | 20 | 9 | 1 | 22 |
| F3 | 3.5 | 3.0 | 4.5 | Std | — | — | — |
| F4 | 4.0 | 4.0 | 4.5 | −1 | −16 | −3 | 16 |
| G1 | 4.0 | 3.0 | 4.5 | Std | — | — | — |
| G2 | 4.5 | 3.5 | 4.5 | −44 | −100 | −62 | 126 |
| H1 | 4.0 | 3.5 | 4.5 | Std | — | — | — |
| H2 | 4.5 | 4.0 | 4.5 | −26 | 2 | 3 | 27 |

Crockfastness for each of the samples is listed below in Table VI:

TABLE VI

| | As Received | | One Wash | |
|---|---|---|---|---|
| Sample | Wet | Dry | Wet | Dry |
| D1 | 5.0 | 4.5 | | |
| D2 | 4.0 | 4.5 | 5.0 | 5.0 |
| E1 | 4.5 | 4.0 | | |
| E2 | 4.0 | 4.5 | 5.0 | 4.5 |
| F1 | 3.0 | 4.5 | | |
| F2 | 2.0 | 3.0 | 4.0 | 3.0 |
| F3 | 4.0 | 4.0 | | |
| F4 | 2.0 | 3.0 | 4.0 | 3.0 |
| G1 | 3.5 | 2.5 | | |
| G2 | 2.0 | 3.5 | 4.5 | 4.0 |
| H1 | 4.5 | 4.0 | | |
| H2 | 2.5 | 3.5 | 4.5 | 4.0 |

As illustrated, the fabrics processed according to the instant invention did not undergo any significant shade change. As will be appreciated by those of ordinary skill in the art, a DE of 100 or less is considered to represent good shade consistency from the standard. The sole value which was above this level was on 18, and it was primarily a depth change rather than a significant color change. Furthermore, in view of the fact that the other samples processed in the same manner had such low DE values, it is hypothesized by the inventors that an irregularity may have occurred at some stage in the processing of this sample, resulting in the higher DE value it displayed.

Table VII below illustrates the current commercial colorfastness expectations for an acceptable lot of textile material (microfiber) for each of the colors shown below in I-M.

TABLE VII

| | IIA Wash Test | | |
|---|---|---|---|
| Color | Polyester | Nylon | Cotton |
| Sample I Dark Navy | 4.0 | 3.5 | 4.5 |
| Sample J Medium Navy | 3.5 | 3.5 | 4.5 |
| Sample K Bright Red | 3.5 | 3.0 | 4.5 |
| Sample L Deep Red | 3.5 | 2.5 | 4.5 |
| Sample M Royal Blue | 4.0 | 3.0 | 4.5 |

Example VII

A 100% polyester jersey microdenier fabric was knit from 1/70/100 yarns. Samples of the fabric were dyed various colors and treated as follows:

Sample I- Dark Navy

Dye Mixture: 1.4676% o.w.g. Disperse Yellow dye mixture, 1.4744% o.w.g. C.I. Disperse Violet 91, and 2.7550% C.I. Disperse Blue 284.

I1, I3, I5 and I7- Were dyed and aftercleared in a conventional manner using 2.0% o.w.g. Soda Ash and 0.5% o.w.g. Thiourea Dioxide at 160° F. for 20 minutes. The fabric was then heatset at 370° F.

I2, I4, I6 and I8- Were dyed and aftercleared with 2.0% o.w.g. Soda Ash and 0.5% o.w.g. Thiourea Dioxide, heatset at 370° F, then padded with a polysiloxane/organo-tin compound mixture containing 6 g/L polysiloxane and 3 g/L of the organo-tin component. The fabrics were then dried at 275° F.

Sample J- Medium Navy

Dye Mixture: 0.5000% o.w.g. C.I. Disperse Yellow 108, 0.7900% o.w.g. Disperse Red dye mixture, and 3.0000% C.I. Disperse Blue 281.

J1- Was dyed and aftercleared in a conventional manner using 2.0% o.w.g. Soda Ash and 0.5% o.w.g. Thiourea Dioxide at 160° F. for 20 minutes. The fabric was then heatset at 370° F.

J2- Was dyed and aftercleared as J1, then heatset at 370° F., then padded with a mixture of a polysiloxane and an organo-tin compound containing 6 g/L polysiloxane and 3 g/L of the organo-tin component. The fabric was then dried at 275° F.

Sample K- Bright Red

Dye Mixture: 0.4100% o.w.g. C.I. Disperse Orange 30, 4.5000% o.w.g. C.I. Disperse Red 356, 2.3500% o.w.g. C.I. Disperse Red 279, and 0.0150% o.w.g. C.I. Disperse Blue 56.

K1- Was dyed and aftercleared in a conventional manner using 2.0% o.w.g. Soda Ash and 0.5% o.w.g. Thiourea Dioxide at 160° F. for 20 minutes. The fabric was then heatset at 370° F.

K2- Was dyed and aftercleared in the manner of K1, then heatset at 370° F. It was then padded with a mixture of a polysiloxane and an organo-tin compound. The fabric was then dried at 275° F.

Sample L- Deep red

Dye Mixture: 1.0500% o.w.g. Disperse Yellow dye mixture, 3.0000% o.w.g. C.I. Disperse Red 167, and 1.0000% o.w.g. C.I. Disperse Violet 91. L1- Was dyed and aftercleared in a conventional manner using 2.0% o.w.g. Soda Ash and 0.5% o.w.g. Thiourea Dioxide at 160° F. for 20 minutes. The fabric was then heatset at 370° F.

L2- Was dyed and aftercleared as L1, then heatset at 370° F., then padded with a mixture of a polysiloxane and an organo-tin compound. The fabric was then dried at 275° F.

Sample M- Royal Blue

Dye Mixture- 1.815% o.w.g. C.I. Disperse Blue 56 and 0.7300% o.w.g. C.I. Disperse Blue 60.

M1- Was dyed and aftercleared in a conventional manner using 2.0% o.w.g. Soda Ash and 0.5% o.w.g. Thiourea Dioxide at 160° F. for 20 minutes. The fabric was then heatset at 370° F.

M2- Was dyed and aftercleared as M1, then heatset at 370° F., then padded with a mixture of a polysiloxane and an organo-tin compound. The fabric was then dried at 275° F.

Wash test data and Shade Test results are listed below in Table VIII:

TABLE VIII

| | IIA Wash Test | | | Shade | | | |
|---|---|---|---|---|---|---|---|
| Sample | Polyester | Nylon | Cotton | DL | Da | Db | DE |
| I1 | 4.0 | 3.0 | 4.5 | Std | — | — | — |
| I2 | 4.5 | 4.0 | 5.0 | 40 | 1 | 20 | 45 |
| I3 | 4.0 | 3.0 | 4.5 | Std | — | — | — |
| I4 | 4.5 | 4.0 | 5.0 | 21 | −16 | 21 | 34 |
| I5 | 4.5 | 3.0 | 4.5 | Std | — | — | — |
| I6 | 5.0 | 4.0 | 5.0 | 4 | 8 | 6 | 11 |
| I7 | 4.5 | 3.5 | 4.5 | Std | — | — | — |
| I8 | 5.0 | 4.5 | 5.0 | 104 | −12 | −1 | 105 |
| J1 | 4.0 | 4.0 | 4.5 | Std | — | — | — |
| J2 | 4.5 | 4.0 | 4.5 | 18 | 8 | 25 | 32 |
| K1 | 3.5 | 3.0 | 4.0 | Std | — | — | — |
| K2 | 4.0 | 4.0 | 4.5 | 19 | −11 | −10 | 24 |
| L1 | 3.5 | 2.5 | 4.5 | Std | — | — | — |
| L2 | 4.0 | 3.5 | 4.5 | 3 | −19 | −12 | 23 |
| M1 | 4.0 | 3.0 | 4.5 | Std | — | — | — |
| M2 | 4.5 | 4.5 | 5.0 | 31 | −20 | 71 | 80 |

Colorfastness for each of the samples is listed below in Table IX:

TABLE IX

| | As Received | |
|---|---|---|
| Sample | Wet | Dry |
| I1 | 4.5 | 4.0 |
| I2 | 4.5 | 4.5 |
| I3 | 4.5 | 4.0 |
| I4 | 4.0 | 4.5 |
| I5 | 4.5 | 4.5 |
| I6 | 4.0 | 4.0 |
| I7 | 4.5 | 4.0 |
| I8 | 4.0 | 4.5 |
| J1 | 4.5 | 4.0 |
| J2 | 4.0 | 4.0 |
| K1 | 4.0 | 3.5 |
| K2 | 3.5 | 3.5 |
| L1 | 4.0 | 3.0 |
| L2 | 4.0 | 4.0 |
| M1 | 4.5 | 4.5 |
| M2 | 4.5 | 4.5 |

As can readily be seen by the examples, the fabrics which were processed according to the instant invention had improved washfastness, particularly with respect to the nylon and polyester fibers. It is to be noted that cotton was relatively good overall, presumable because the detergents generally used for these types of fabrics include an optical whitener which therefore tends to give the cotton a good rating in virtually all instances. In fact, it was found that with the exception of Sample L, all of the samples had a rating of 4.0 or greater for each fiber (Sample L's deficiency being attributable to an improper match of dyestuffs). In fact, the average washfastness improvement was 0.5 for polyester, 0.8 for nylon, and 0.4 for cotton. In addition, the textile materials had good shade ratings and colorfastness, particularly after one laundering.

In the specification there has been set forth a preferred embodiment of the invention, and although specific terms are employed, they are used in a generic and descriptive sense only and not for purpose of limitation, the scope of the invention being defined in the claims.

We claim:

1. A process for producing dyed thermoplastic textile materials comprising the steps of:

providing a heatset dyed thermoplastic textile material;

applying a polysiloxane/organo-tin compound to the textile material; and drying the textile material, to thereby provide a textile material having good colorfastness.

2. A process according to claim 1, wherein said step of providing a heatset dyed thermoplastic textile material comprises the steps of dyeing a textile material and then heatsetting the textile material.

3. A process according to claim 2, further comprising the step of afterclearing the textile material subsequent to dyeing.

4. A process according to claim 1, wherein said step of providing a heatset dyed thermoplastic textile material comprises the steps of heatsetting and then dyeing the textile material.

5. A process according to claim 4, further comprising the step of afterclearing the textile material subsequent to dyeing.

6. A process according to claim 1, wherein said step of applying a polysiloxane/organo-tin compound to the textile material comprises applying the compound at a level of about 6 g/L polysiloxane and about 3 g/L organo-tin component.

7. A process according to claim 1, wherein said step of drying comprises drying the textile material at a temperature of about 325° F. or less.

8. A process according to claim 7, wherein said step of drying comprises drying the textile material at a temperature of about 300° F. or less.

9. A process according to claim 8, wherein said step of drying comprises drying the textile material at a temperature of about 275° or less.

10. A process according to claim 9, wherein said step of drying comprises drying the textile material at a temperature of about 250° F. or less.

11. A process according to claim 1, wherein said thermoplastic textile material comprises microdenier fibers.

* * * * *

UNITED STATES PATENT AND TRADEMARK OFFICE

CERTIFICATE OF CORRECTION

PATENT NO. : 6,451,234 B1
DATED : September 17, 2002
INVENTOR(S) : James D. Cliver and Dale R. Williams It is certified that error appears in the above-identified patent and that said Letters Patent is hereby corrected as shown below:

Title page, Item [54] and Column 1, line 3,
After the word "COLORFASTNESS" insert -- , AND MATERIALS MADE THEREFROM --.

Signed and Sealed this

Fifteenth Day of July, 2003

JAMES E. ROGAN
*Director of the United States Patent and Trademark Office*